US012553209B2

(12) United States Patent
Han et al.

(10) Patent No.: US 12,553,209 B2
(45) Date of Patent: Feb. 17, 2026

(54) BUOYANCY RESISTANCE PILE FOR SUBSEA STRUCTURE INSTALLATION

(71) Applicant: KOREA INSTITUTE OF OCEAN SCIENCE & TECHNOLOGY, Busan (KR)

(72) Inventors: Taek Hee Han, Busan (KR); Seokjae Lee, Busan (KR)

(73) Assignee: KOREA INSTITUTE OF OCEAN SCIENCE & TECHNOLOGY, Busan (KR)

( * ) Notice: Subject to any disclaimer, the term of this patent is extended or adjusted under 35 U.S.C. 154(b) by 77 days.

(21) Appl. No.: 18/602,779

(22) Filed: Mar. 12, 2024

(65) Prior Publication Data

US 2024/0337086 A1 Oct. 10, 2024

(30) Foreign Application Priority Data

Apr. 4, 2023 (KR) ..... 10-2023-0044333

(51) Int. Cl.
*E02D 27/52* (2006.01)
*E02D 5/30* (2006.01)
*E02D 5/54* (2006.01)

(52) U.S. Cl.
CPC ..... *E02D 27/525* (2013.01); *E02D 5/30* (2013.01); *E02D 5/54* (2013.01); *E02D 2600/30* (2013.01)

(58) Field of Classification Search
CPC ..... E02D 27/525; E02D 5/30; E02D 5/54; E02D 5/52
See application file for complete search history.

(56) References Cited

U.S. PATENT DOCUMENTS 4,561,804 A * 12/1985 Weatherby ..... E02D 29/0283 405/262
9,435,096 B2 * 9/2016 Shin ..... E02D 27/50

FOREIGN PATENT DOCUMENTS

| | | | |
|---|---|---|---|
| JP | 2015-212507 | A | 11/2015 |
| KR | 10-0985823 | B1 | 10/2010 |
| KR | 10-1672997 | B1 | 11/2016 |

* cited by examiner

*Primary Examiner* — Sean D Andrish
(74) *Attorney, Agent, or Firm* — Bridgeway IP Law Group, PLLC; Sang Ho Lee; Hyun Woo Shin

(57) ABSTRACT

Provided is a buoyancy-resistant pile for subsea structure installation, the buoyancy-resistant pile including: a pile main body having one end buried in a seabed or a concrete foundation and having a hollow portion provided therein; and a pull-out resistor coupled to pass through a side surface of the pile main body and buried in the seabed or the concrete foundation.

5 Claims, 10 Drawing Sheets

BUOYANCY RESISTANCE PILE FOR SUBSEA STRUCTURE INSTALLATION

CROSS-REFERENCE TO RELATED APPLICATION

This application claims priority to and the benefit of Korean Patent Application No. 10-2023-0044333, filed on Apr. 4, 2023, the disclosure of which is incorporated herein by reference in its entirety.

BACKGROUND

1. Field of the Invention

The present invention relates to buoyancy-resistant pile technology for subsea structure installation.

2. Discussion of Related Art

Due to problems such as a rise in sea level, an increase in design wave height, and a lack of land space that are caused by climate change, the demand for securing marine spatial resources is increasing. Accordingly, ideas to construct structures in a marine space are being derived.

When building a structure in a marine space, foundation work for reinforcing the seabed may be performed to support the structure, and here, piles may be used. However, piles used on the seabed may be more vulnerable to a pull-out force caused by buoyancy compared to when the piles are used in a typical ground construction environment.

Accordingly, the inventor of the present invention has completed the present invention after a long period of research and trial and error on piles that can resist buoyancy in order to be suitable for subsea structures.

SUMMARY OF THE INVENTION

The present invention is directed to a buoyancy-resistant pile for subsea structure installation that has high resistance to pull-out.

Meanwhile, other unstated objectives of the present invention will be additionally considered within the scope easily inferable from the following detailed description and advantageous effects thereof.

According to an aspect of the present invention, there is provided a buoyancy-resistant pile for subsea structure installation, the buoyancy-resistant pile including: a pile main body having one end buried in a seabed or a concrete foundation and having a hollow portion provided therein; and a pull-out resistor coupled to pass through a side surface of the pile main body and buried in the seabed or the concrete foundation.

The pile main body may include: an inner tube configured to surround the hollow portion; an outer tube configured to surround the inner tube; and a concrete material formed between the inner tube and the outer tube.

A through-hole passing through an outer circumferential surface of the pile main body and connected to the hollow portion may be formed, and the pull-out resistor may be inserted into the through-hole.

Threads may be formed on an inner circumferential surface of the through-hole, and the pull-out resistor may include a bolt member that is able to be screw-coupled to the threads of the through-hole.

The pull-out resistor may be a reinforcing bar member configured to pass through the through-hole.

The pull-out resistor may be obliquely coupled to the outer circumferential surface of the pile main body.

The pull-out resistor may be formed as a plurality of pull-out resistors disposed spaced apart along a circumference of the pile main body.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

Figure 1:
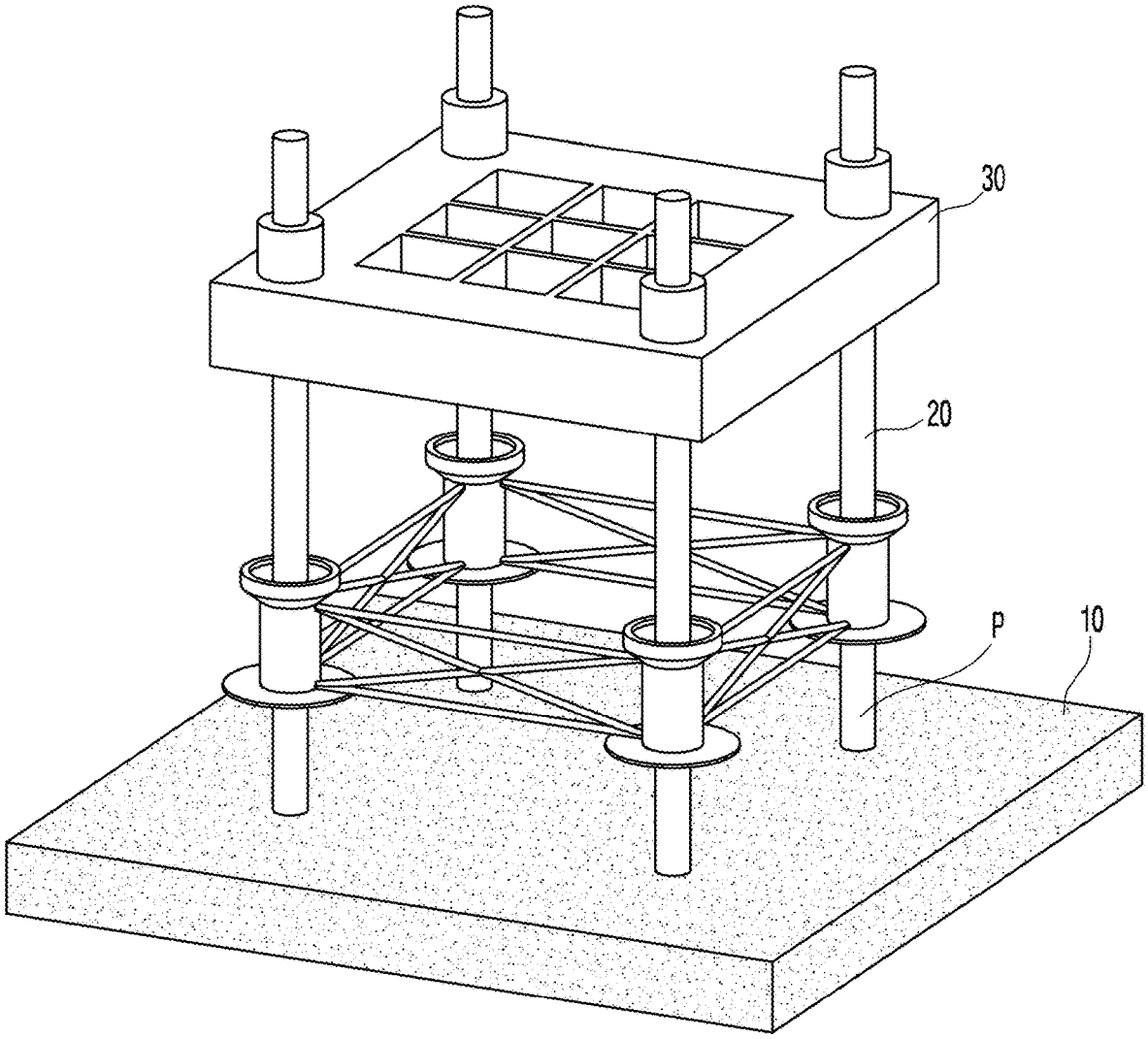
FIGS. 1 and 2 are views illustrating examples of subsea structures built on the seabed.

It should be noted that the accompanying drawings are only illustrated as a reference to assist in understanding of the technical spirit of the present invention, and the scope of rights of the present invention is not limited by the accompanying drawings.

DETAILED DESCRIPTION OF EXEMPLARY EMBODIMENTS

In describing the present invention, when a detailed description of relevant known functions that are self-evident to those of ordinary skill in the art is determined as having the possibility of unnecessarily obscuring the gist of the present invention, the detailed description thereof will be omitted.

Terms used in the present application are only used to describe specific embodiments and are not intended to limit the present invention. A singular expression includes a plural expression unless the context clearly indicates otherwise.

Terms such as first and second are only identifiers to distinguish the same or corresponding components, and the same or corresponding components are not limited by the terms such as first and second.

In the present application, terms such as "include" or "have" are intended to designate the presence of features, numbers, steps, operations, components, parts, or combinations thereof described herein and should not be understood as precluding the possibility of the presence or addition of one or more other features, numbers, steps, operations, components, parts, or combinations thereof.

Also, in the contact relationship between two components, coupling is a concept that not only encompasses a case where the two components are in direct physical contact with each other but also a case where another component is interposed between the two components, and the two components are each in contact with the other component.

Hereinafter, embodiments of a buoyancy-resistant pile for subsea structure installation according to the present invention will be described in detail with reference to the accompanying drawings, and in the description with reference to the accompanying drawings, the same or corresponding components will be denoted by the same reference numerals, and overlapping description thereof will be omitted.

Figure 2:
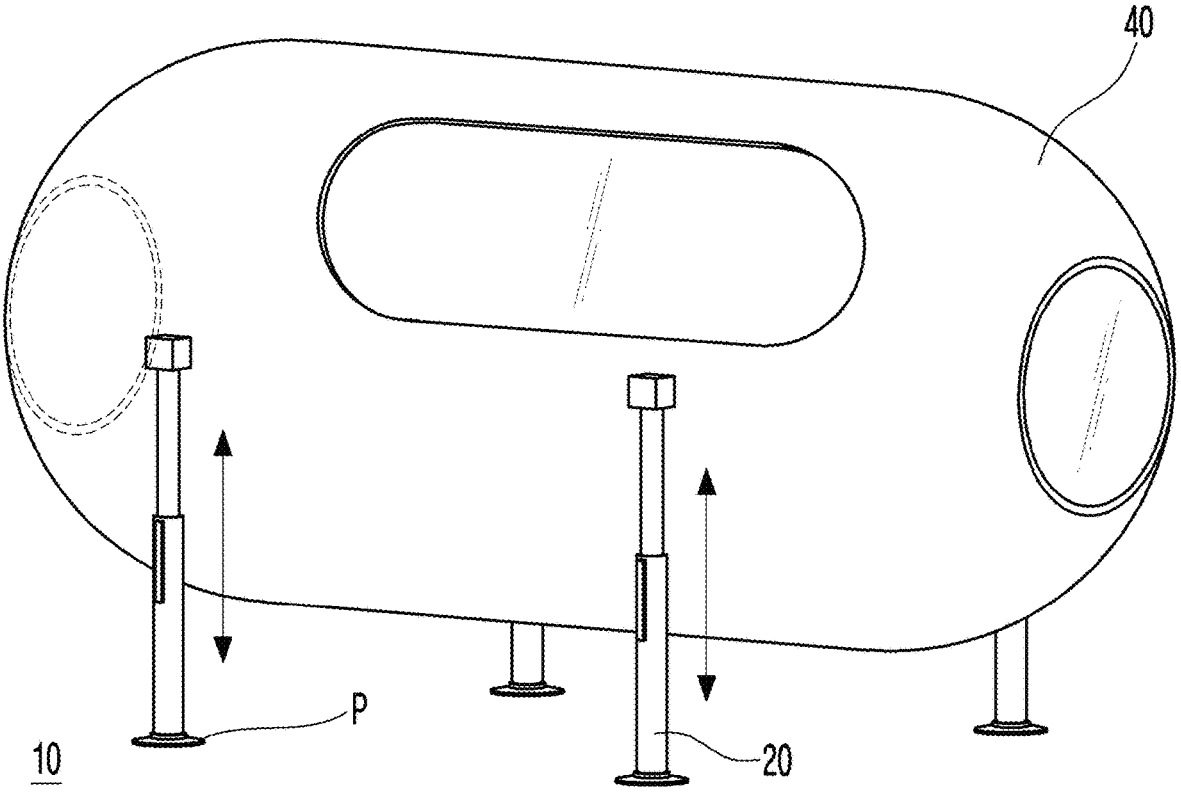
Figure 3:
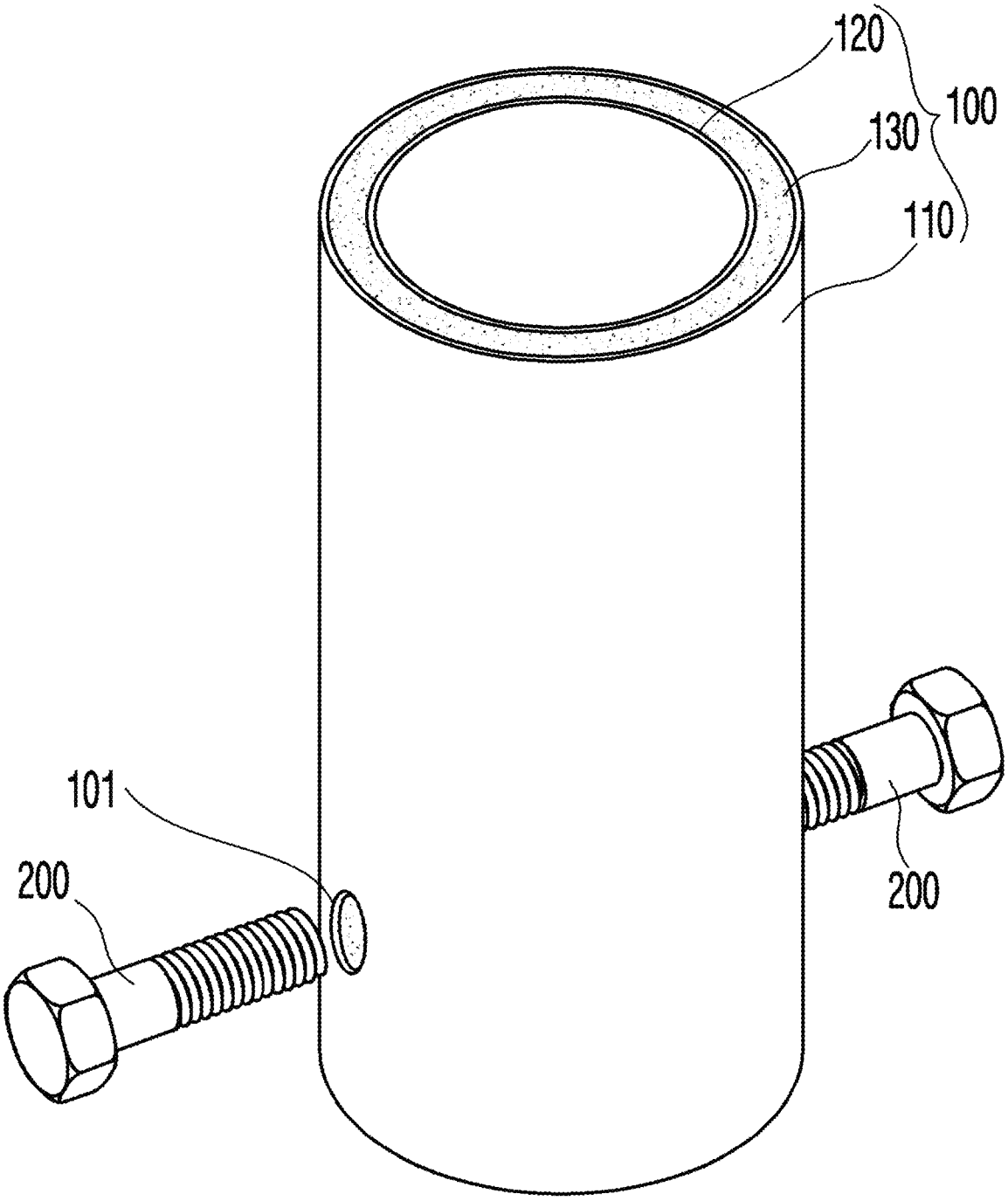
FIG. 3 is a view illustrating a buoyancy-resistant pile for subsea structure installation according to an embodiment of the present invention.
Figure 4A:
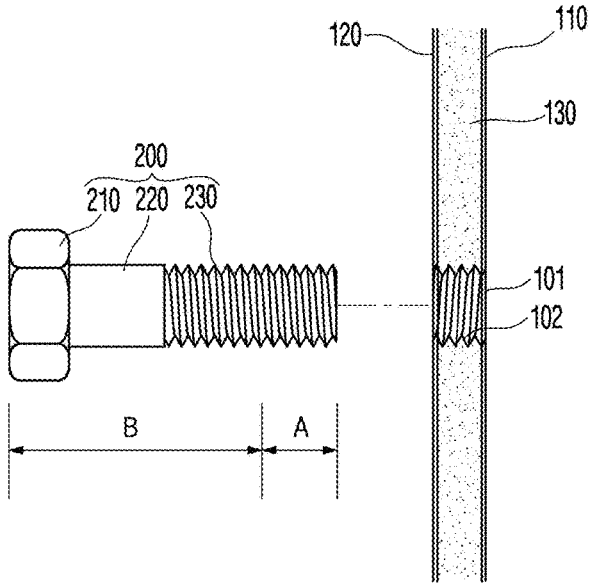
FIGS. 4A and 4B are views illustrating the coupling of a pull-out resistor of the buoyancy-resistant pile for subsea structure installation according to an embodiment of the present invention.
Figure 4B:
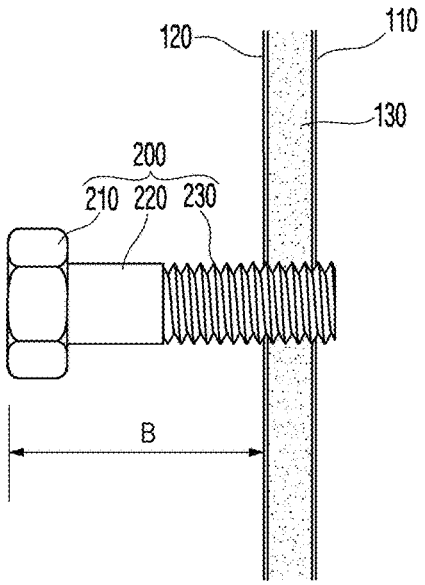
Figure 5:
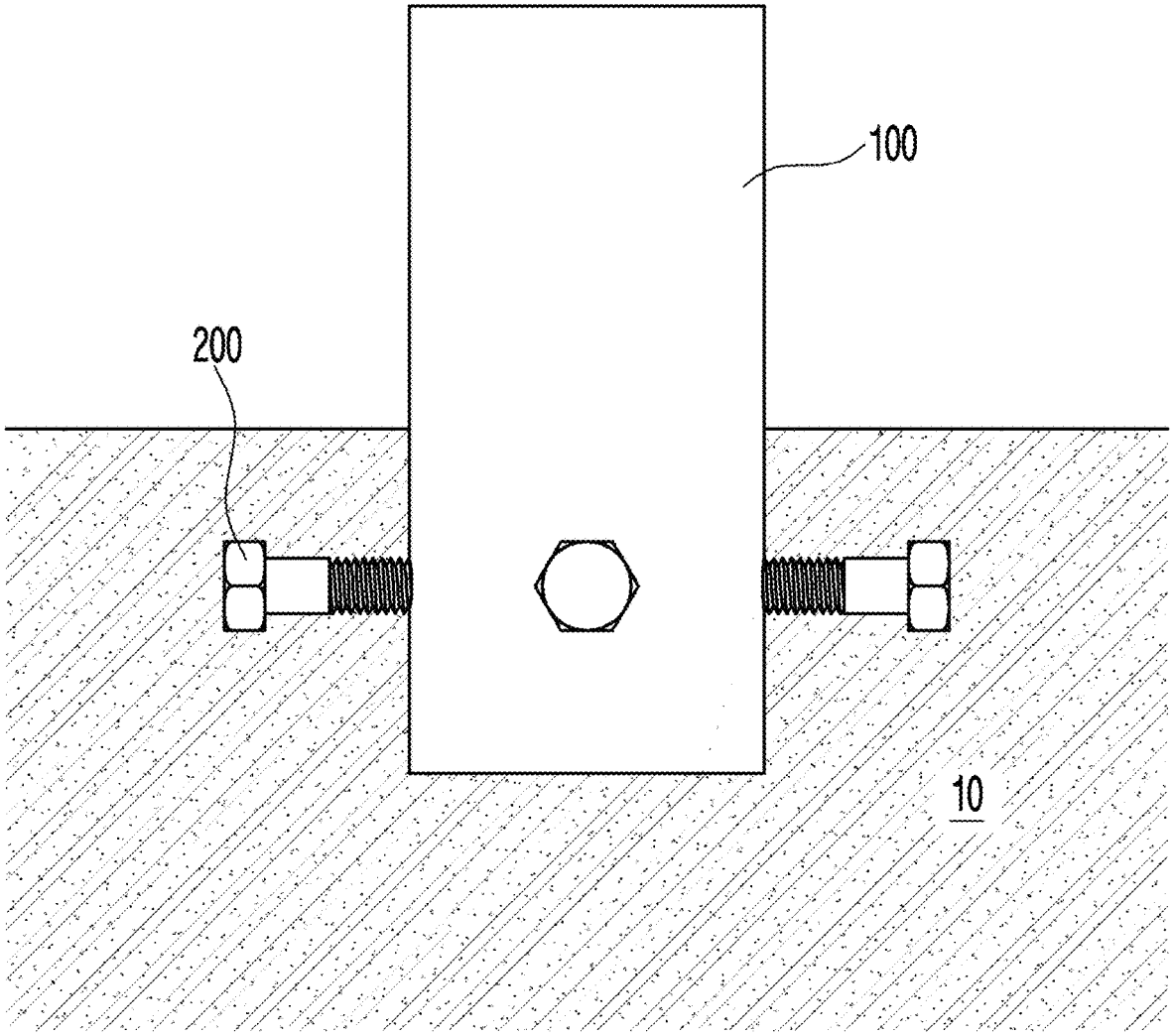
FIG. 5 is a view illustrating a state in which the buoyancy-resistant pile for subsea structure installation according to an embodiment of the present invention is inserted into the seabed.
Figure 6A:
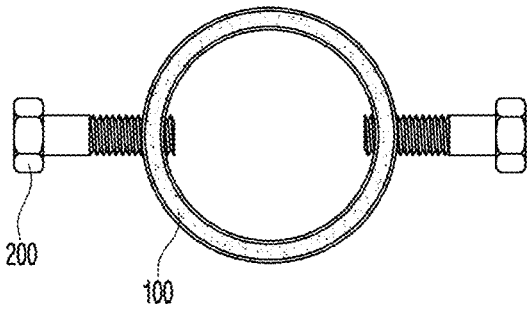
FIGS. 6A, 6B and 6C show cross-sectional views of the buoyancy-resistant pile for subsea structure installation according to an embodiment of the present invention.
Figure 6B:
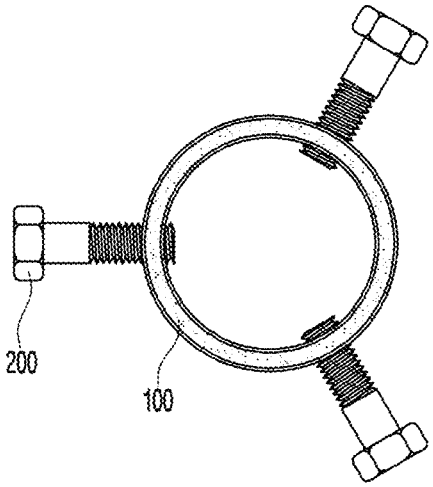
Figure 6C:
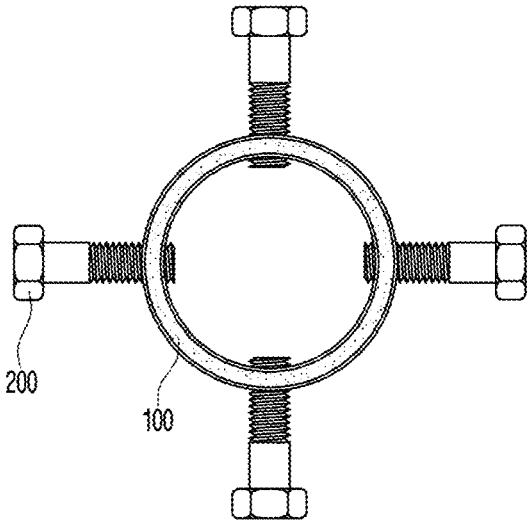
Figure 7:
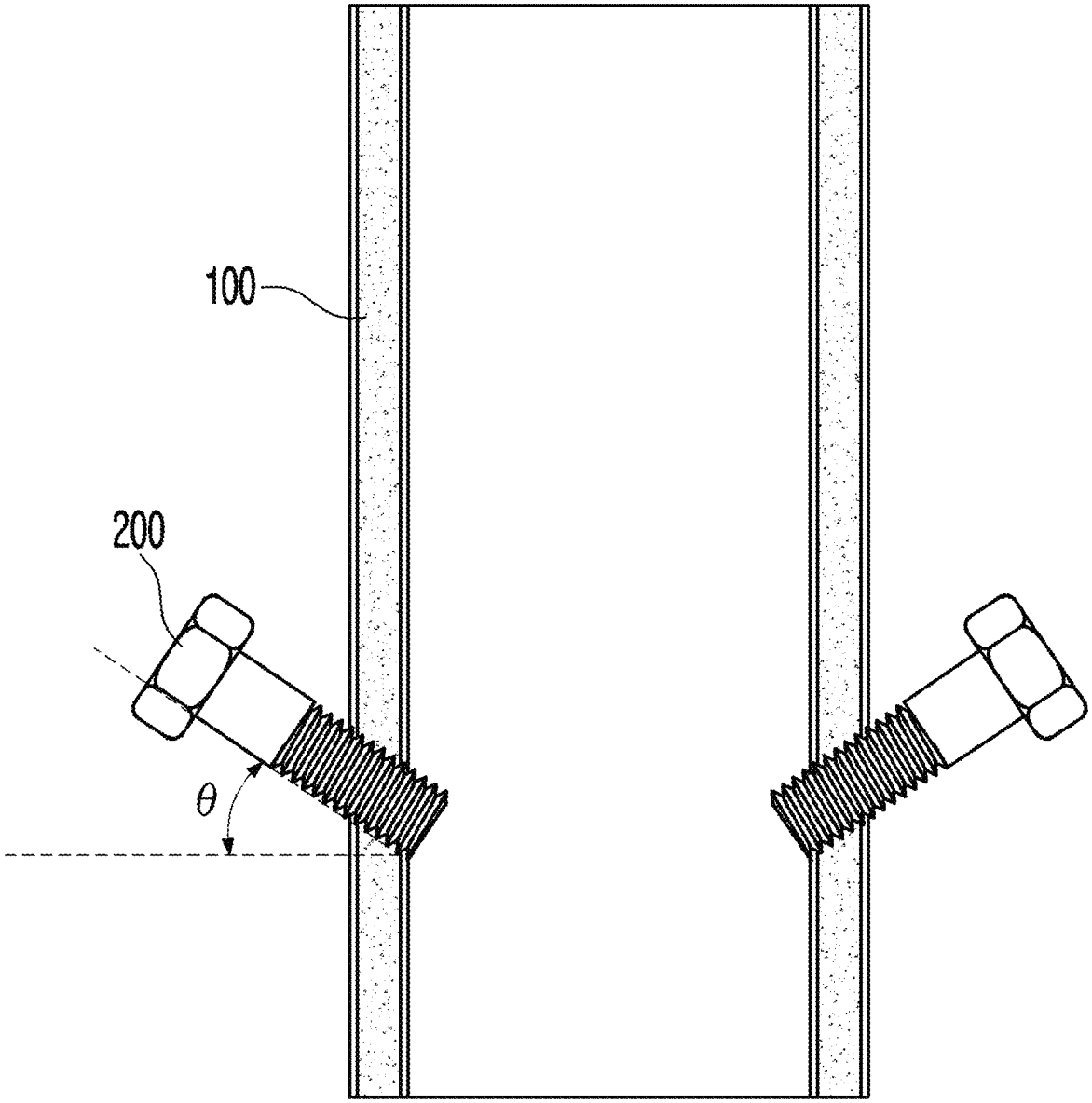
FIG. 7 is a view illustrating the oblique coupling of the pull-out resistor of the buoyancy-resistant pile for subsea structure installation according to an embodiment of the present invention.

FIGS. 1 and 2 are views illustrating examples of subsea structures built on the seabed. FIG. 3 is a view illustrating a buoyancy-resistant pile for subsea structure installation according to an embodiment of the present invention. FIGS. 4A and 4B are views illustrating the coupling of a pull-out resistor of the buoyancy-resistant pile for subsea structure installation according to an embodiment of the present invention. FIG. 5 is a view illustrating a state in which the buoyancy-resistant pile for subsea structure installation according to an embodiment of the present invention is inserted into the seabed. FIGS. 6A, 6B and 6C show cross-sectional views of the buoyancy-resistant pile for subsea structure installation according to an embodiment of the present invention. FIG. 7 is a view illustrating the oblique coupling of the pull-out resistor of the buoyancy-resistant pile for subsea structure installation according to an embodiment of the present invention. FIGS. 8, 9A, 9B, 9C and 9D are views illustrating pull-out resistors in the form of reinforcing bars of the buoyancy-resistant pile for subsea structure installation according to an embodiment of the present invention. FIGS. 10A, 10B, 10C and 10D respectively show cross-sectional views of FIGS. 9A, 9B, 9C and 9D.

Various offshore structures may be installed offshore. In the present specification, description will be given by referring to an offshore structure fixed to the seabed as a "subsea structure." A subsea structure may be implemented in various forms. A subsea structure may have a lower end fixed to the seabed and an upper portion exposed to the sea surface. Examples of a subsea structure may include a wind turbine. A subsea structure may be a subsea platform fixed to the seabed and not exposed to the sea surface. Such a subsea structure may be utilized in various ways, such as a research space, a living space, and a commercial space. However, the form or use of a subsea structure is not limited in the present invention.

A subsea structure may be manufactured as a module on the ground and then transported and installed on the seabed. A plurality of subsea structures may be formed, and the plurality of subsea structures may be connected or assembled to each other. A chamber 40 illustrated in FIG. 2 may be one of the subsea structures, and a plurality of chambers similar to the chamber 40 may be manufactured and connected or assembled to each other on the seabed. The plurality of chambers may be partitioned from each other and each utilized in various ways, such as a laboratory, a living space, and a data center.

A subsea structure may be installed on a ground structure. The ground structure may support the subsea structure.

Referring to FIG. 1, the ground structure may include a pile P. The pile P is a buoyancy-resistant pile suitable for subsea structure installation. That is, the pile P is located on the seabed so as to not be easily pulled out by buoyancy. The pile P may be directly inserted (buried) into a seabed 10 or inserted (buried) into a concrete foundation (not illustrated).

Meanwhile, the ground structure may further include at least one of a foundation, a support frame 30, and a cylinder 20. The foundation may include a concrete foundation. The support frame 30 may include a concrete beam. The cylinder 20 may include a hydraulic cylinder. At least a part of the cylinder 20 may be able to move up and down due to hydraulic pressure. Due to the cylinder 20 being implemented in a hydraulic manner, the ground structure may be implemented as a hydraulic ground structure.

Here, the subsea structure may be coupled to at least one of an upper portion of the pile P, an upper portion of the foundation, an upper portion of the support frame 30, and an upper portion of the cylinder 20.

Meanwhile, the ground structure may further include a cross beam configured to connect and support the pile P and/or the cylinder 20, but the present invention is not limited thereto.

The coupling relationship of the pile P, the foundation, the support frame 30, and the cylinder 20 may vary.

For example, as illustrated in FIG. 1, the pile P may be inserted (buried) into the seabed 10, the cylinder 20 may be installed on the pile P, and the support frame 30 may be installed on the cylinder 20. Also, the subsea structure may be installed on the upper portion of the support frame 30.

Here, the cylinder 20 may be implemented as a hydraulic cylinder, and the support frame 30 and the subsea structure may move up and down according to the upward/downward movement of the cylinder 20. For example, when the subsea structure is initially installed on the seabed, the support frame 30 may move downward according to the movement of the cylinder 20, and accordingly, the subsea structure may be stably seated on the seabed 10. Also, for maintenance and management of the subsea structure, the subsea structure may also move up and down according to the movement of the cylinder 20.

Referring to FIG. 2, the pile P may be inserted (buried) into the seabed 10, the cylinder 20 may be installed on the pile P, and the subsea structure may be coupled to an upper end of the cylinder 20.

Here, the cylinder 20 may be implemented as a hydraulic cylinder, and the subsea structure may also move up and down according to the movement of the cylinder 20.

Also, although not illustrated in the drawings, a foundation (concrete foundation) may be formed on the seabed 10, and the pile P may be inserted (buried) into the foundation. The cylinder 20 may be coupled to an upper portion of the pile P, and the subsea structure may be coupled to the upper end of the cylinder 20. Alternatively, the support frame 30 may be installed on the upper end of the cylinder 20, and the subsea structure may be coupled to the upper portion of the support frame 30.

In short, the ground structure may include the pile P, and the configuration of the foundation, the cylinder 20, and the support frame 30 may be modified in various ways. In particular, in a case where the ground structure includes the cylinder 20 (hydraulic cylinder), the subsea structure may move up and down according to the movement of the cylinder 20.

Here, a pull-out force may be generated at the pile P due to an influence of the movement of the cylinder 20, buoyancy generated at the subsea structure, and the like. In the present invention, the pile P may have resistance to pull-out that prevents the pile P from being pulled out easily.

Hereinafter, the buoyancy-resistant pile P for subsea structure installation according to an embodiment of the present invention will be described.

Referring to FIG. 3, the buoyancy-resistant pile for subsea structure installation according to an embodiment of the present invention may include a pile main body 100 and a pull-out resistor 200.

The pile main body 100 is a component having one end buried in the seabed 10 or the concrete foundation and may serve to support the subsea structure.

The pile main body 100 may be formed in the shape of a column. For example, the pile main body 100 may be formed in a cylindrical shape. Also, the pile main body 100 may have a hollow portion provided therein.

The pile main body 100 may have one end buried in the seabed 10 or the concrete foundation and the other end exposed to the outside.

The one end of the pile main body 100 may penetrate into the seabed 10. For example, the pile main body 100 may move downward toward the seabed 10 and penetrate into the seabed 10. The pile main body 100 may penetrate down to a support layer of the seabed 10. To this end, pile driving work may be performed, but the present invention is not limited thereto.

The one end of the pile main body 100 may be inserted into a groove (or pit) previously made in the seabed 10. Here, for the pile main body 100 to be firmly buried, the groove may be filled with clay, concrete, or the like after the pile main body 100 is inserted into the groove. Also, after being inserted into the groove, the pile main body 100 may penetrate deeper due to an external force.

The one end of the pile main body 100 may be buried in the concrete foundation. The one end of the pile main body 100 may be accommodated in a formwork, and the concrete foundation may be formed by the formwork being filled with concrete. Accordingly, the pile main body 100 may be firmly buried in the concrete foundation.

Referring to FIG. 3, the pile main body 100 may include an inner tube 120, an outer tube 110, and a concrete material 130. The pile main body 100 may be a double-skinned composite tubular (DSCT) pile.

The inner tube 120 may be a steel tube configured to surround the hollow portion mentioned above. The outer tube 110 may be a steel tube disposed to surround the inner tube 120. The outer tube 110 is also hollow, and the inner tube 120 may be disposed in the hollow space of the outer tube 110. A separation space may be provided between the inner tube 120 and the outer tube 110. The concrete material 130 may be formed between the inner tube 120 and the outer tube 110. That is, the separation space between the inner tube 120 and the outer tube 110 may be filled with the concrete material 130.

In other words, the inner tube 120 may be installed at an inner circumferential surface of the concrete material 130, which is in the shape of a column having a hollow portion provided therein, and the outer tube 110 may be installed at an outer circumferential surface of the concrete material 130.

The inner tube 120 and the outer tube 110 may each be formed as a circular tube, but the present invention is not limited thereto, and the inner tube 120 and the outer tube 110 may also be implemented as a tube having a polygonal cross-section. In a case where circular tubes are used, there is an advantage in that stiffness against an axial compressive force and bending moment may be exhibited.

Since the inner tube 120 is installed to surround the hollow portion of the concrete material 130 and restrains the movement of the concrete member, the inner tube 120 allows the concrete material 130 to be under a triaxial stress state, thus preventing brittle fracture due to the hollow portion of the concrete material 130 and reinforcing stiffness against a bending moment.

The inner tube 120 may be formed of iron and steel materials. When constructed in a corrosive environment, the inner tube 120 may be made of fiber reinforced plastic (FRP) having corrosion resistance and ductility capacity. More preferably, a reinforcing material may be added to the FRP, and carbon FRP (CFRP), aramid FRP (AFRP), glass FRP (GFRP), and the like may be selectively used according to on-site construction conditions. In a case where the inner tube 120 is configured using FRP and the like, the self-weight of the inner tube 120 is reduced as compared to when the inner tube 120 is configured using steel.

In a case where the inner tube 120 is formed as a circular tube, the hollow portion may also be configured in a cylindrical shape. The size of the hollow portion may be determined in consideration of the self-weight issue during seismic design, concrete material costs, and the like.

The outer tube 110 may be coupled to the outer circumferential surface of the concrete material 130 and formed of iron and steel materials. When constructed in a corrosive environment, the outer tube 110 may be made of FRP having corrosion resistance and ductility capacity. More preferably, a reinforcing material may be added to the FRP, and CFRP, AFRP, GFRP, and the like may be selectively used according to on-site construction conditions.

Since the pile main body 100 has the hollow portion provided therein and thus may be vulnerable to a pull-out force on the seabed, the present invention may include the pull-out resistor 200 configured to restrain the movement of the pile main body 100. (the pull-out resistor is denoted by the reference numeral 200 and/or the reference numeral 300, but here, only the pull-out resistor 200 will be described for convenience of description)

The pull-out resistor 200 may be coupled to pass through a side surface of the pile main body 100. At least a part of the pull-out resistor 200 may be inserted into the pile main body 100, and at least another part of the pull-out resistor 200 may be buried in the seabed 10 or the concrete foundation. Accordingly, the pull-out resistor 200 may restrain the pile main body 100 to the seabed 10 or the inside of the concrete foundation. The pull-out resistor 200 may move along with the pile main body 100 and may be buried, inserted, and/or may penetrate into the seabed 10 or the concrete foundation.

A through-hole 101 may be formed in the pile main body 100. The through-hole 101 may pass through an outer circumferential surface of the pile main body 100 and may be connected to the hollow portion of the pile main body 100. The through-hole 101 may be formed perpendicular to the outer circumferential surface.

The pull-out resistor 200 may be inserted into the through-hole 101 of the pile main body 100. The pull-out resistor 200 may be inserted into the through-hole 101 from the outer circumferential surface side of the pile main body 100. The pull-out resistor may be fixed after being inserted into the through-hole 101 of the pile main body 100.

The pull-out resistor 200 may have one end located outside the pile main body 100 and the other end located inside the concrete material 130 of the pile main body 100 or inside the hollow portion of the pile main body 100. In a case where the other end of the pull-out resistor 200 is located inside the hollow portion of the pile main body 100, a fixer may be coupled to the other end to fix the pull-out resistor 200.

A threaded portion 102 may be formed on an inner circumferential surface of the through-hole 101 of the pile main body 100. The threaded portion 102 includes threads. The threaded portion 102 may be directly formed on the inner circumferential surface of the through-hole 101. Alternatively, a structure having the threaded portion 102 provided on an inner circumferential surface thereof may be coupled to the through-hole 101. The structure may be formed in a ring shape and have the threaded portion 102 formed on the inner circumferential surface thereof. By fitting the structure into the through-hole 101, a through-hole 101 having a threaded portion 102 formed on the inner circumferential surface thereof may be provided.

The pull-out resistor 200 may include a bolt member. The bolt member may be inserted into the through-hole 101 and screw-coupled to the threaded portion 102.

The bolt member may include a head 210, a body 220, and a threaded portion 230.

The head 210 may be formed to have a hexagonal cross-section, but the present invention is not limited thereto. A cross-sectional area of the head 210 may be the largest in the bolt member.

The body 220 may extend from one surface of the head 210. A cross-sectional area of the body 220 may be smaller than the cross-sectional area of the head 210.

The threaded portion 230 may extend from the body 220 and have threads provided on an outer circumferential surface thereof. The threads of the threaded portion 230 may correspond to the threaded portion 102 of the through-hole 101.

For the bolt member to be inserted into and coupled to the through-hole 101, the threaded portion 230 may be inserted into and coupled to the through-hole 101. The threaded portion 230 may be partially or entirely inserted into the through-hole 101. At least a part of the threaded portion 230 may be located in the hollow portion, and in order to fix the bolt member, a nut and/or a washer (not illustrated) may be coupled to the threaded portion 230 located in the hollow portion.

A part of the threaded portion 230 of the bolt member may be located in the pile main body 100, and the remainder of the threaded portion 230, the body 220, and the head 210 may all be located outside the pile main body 100. The part exposed to the outside may be buried in the seabed 10 or the concrete foundation (see FIG. 5).

A length of the part of the bolt member that is exposed to the outside may be increased according to the required pull-out resistance, but since the concrete material 130 may fracture when the length is increased excessively, sufficient mechanical consideration is needed during design.

Referring to FIG. 4A, in the bolt member, when the bolt member is inserted into the pile main body 100 as illustrated in FIG. 4B, a part of the bolt member that is inserted into the pile main body 100 may be called the "inserted part A," and a part of the bolt member that is located outside the pile main body 100 may be called the "exposed part B." A ratio of the length of the exposed part B to the overall length of the bolt member may range from 0.5 to 0.65.

An experiment was conducted using a model scaled down to a certain ratio relative to the actual size. After the pile main body 100 having two pull-out resistors 200 coupled thereto was inserted into concrete, an upward force was applied to the pile main body 100. The experiment was conducted ten times for each ratio of the length of the exposed part B to the overall length of the bolt member, and the results thereof are shown in [Table 1] below.

TABLE 1

| Ratio of length of exposed part B to overall length | Resistance to pull-out | Fracture of pile main body | Fracture of pull-out resistors |
|---|---|---|---|
| 0.4 | Low | X | X |
| 0.45 | Low | X | X |
| 0.5 | High | X | X |
| 0.55 | High | X | X |
| 0.6 | High | X | X |
| 0.65 | High | X | X |
| 0.7 | Low | 7 times | 2 times |
| 0.75 | Low | 9 times | 1 time |

Referring to [Table 1], resistance to pull-out was high when the ratio of the length of the exposed part B to the overall length of the bolt member ranged from 0.5 to 0.65, and when the ratio was lower than 0.5, resistance to pull-out was low due to the length of the exposed part B being too short. Also, when the ratio was higher than 0.65, resistance to pull-out was low due to fracture of the pile main body 100 or the pull-out resistors 200. When the ratio was higher than 0.65, fracture of the concrete material 130 was frequently caused in the pile main body 100, and fracture of the pull-out resistors 200 was also intermittently caused.

Referring to FIGS. 3 to 6, in order to increase resistance to pull-out, the pull-out resistor 200 may be formed as a plurality of pull-out resistors 200. A plurality of through-holes 101 may also be formed in a number corresponding to the number of pull-out resistors 200. The plurality of pull-out resistors 200 may be disposed spaced apart along the circumference of the pile main body 100.

The plurality of pull-out resistors 200 may be composed of two pull-out resistors 200, and the two pull-out resistors 200 may be coupled to the pile main body 100 to face each other.

The plurality of pull-out resistors 200 may be composed of four pull-out resistors 200, and the four pull-out resistors 200 may be coupled to the pile main body 100 so that two pairs of pull-out resistors 200 face each other.

FIG. 6A illustrates a case where the number of pull-out resistors 200 is two, FIG. 6B illustrates a case where the number of pull-out resistors 200 is three, and FIG. 6C illustrates a case where the number of pull-out resistors 200 is four. In each case, the pull-out resistors 200 may be disposed to be spaced apart at equal intervals. In FIGS. 6A, 6B, and 6C, the pull-out resistors 200 may be disposed at 180° intervals, 120° intervals, and 90° intervals, respectively.

As illustrated in FIG. 5, the plurality of pull-out resistors 200 may be disposed at equal intervals at the same height and buried in the seabed 10 or the concrete foundation, and accordingly, the pull-out resistors 200 may provide even pull-out resistance around the pile main body 100. The length of the exposed part may be the same in each of the plurality of pull-out resistors 200. However, the present invention is not limited thereto, and according to the form of the seabed 10, the length of the exposed part may be different in at least some of the plurality of pull-out resistors 200.

The plurality of pull-out resistors 200 may be composed of two to four pull-out resistors 200. When the number of pull-out resistors 200 is five or more, due to an increase in the number of through-holes 101, fracture of the pile main body 100 may occur in the vicinity of the holes.

Referring to FIG. 7, the pull-out resistors 200 may be obliquely coupled to the outer circumferential surface of the pile main body 100.

The pull-out resistors 200 may be obliquely coupled to the outer circumferential surface of the pile main body 100 in a form in which each pull-out resistor 200 has an upward slope toward the outside. In this case, as in FIG. 7, the pull-out resistors 200 may be disposed in a V-shape. An angle of inclination θ of each pull-out resistor 200 may be shown as an angle of the pull-out resistor 200 relative to a plane perpendicular to the outer circumferential surface of the pile main body 100.

The angle of inclination θ may range from 0° to 50°. In a case where the angle of inclination θ is 0°, the pull-out resistor 200 is coupled perpendicularly to the outer circumferential surface of the pile main body 100 as in FIG. 4B described above, and when the angle of inclination θ exceeds 50°, a pull-out resistance effect may not be obtained. However, the angle of inclination θ may vary according to the required pull-out resistance, the stiffness of the pile main body 100, and the like.

Also, the pull-out resistors 200 may be obliquely coupled to the outer circumferential surface of the pile main body 100 in a form in which each pull-out resistor 200 has a downward slope toward the outside. (That is, unlike in FIG. 7, the pull-out resistors 200 may be disposed in an inverted V-shape). In this case, the angle of inclination θ may range from 0° to 10°. When the angle of inclination θ exceeds 10°, a pull-out resistance effect may not be obtained. However, the angle of inclination θ may vary according to the required pull-out resistance, the stiffness of the pile main body 100, and the like.

Figure 8:
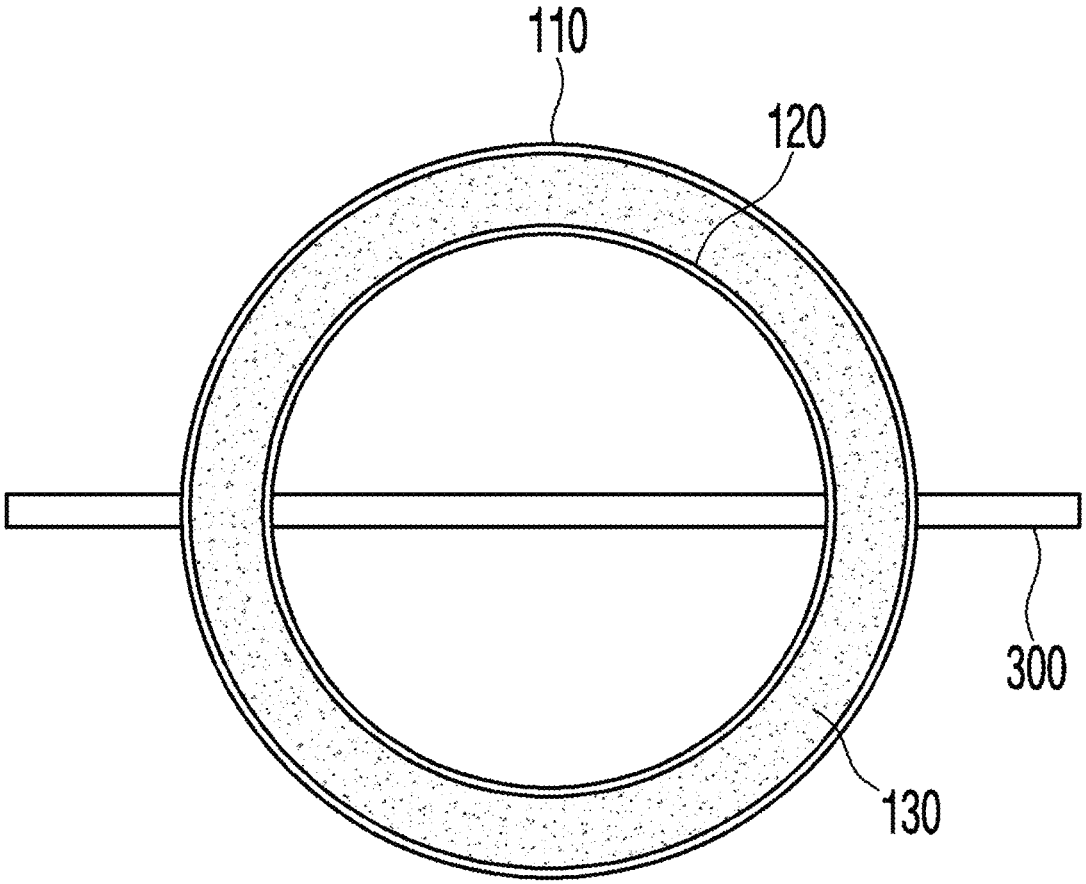
FIGS. 8, 9A, 9B, 9C and 9D are views illustrating pull-out resistors in the form of reinforcing bars of the buoyancy-resistant pile for subsea structure installation according to an embodiment of the present invention.

Referring to FIG. 8, a pull-out resistor 300 may be a reinforcing bar member passing through the through-hole 101. The pull-out resistor 300 having such a form may be coupled to cross the entire pile main body 100. Since the through-hole 101 is formed at each of both sides of the pull-out resistor 300 in the form of a reinforcing bar member, two through-holes 101 may be formed for a single pull-out resistor 300.

The reinforcing bar member may pass through the through-holes 101 and may be fixed to the pile main body 100. For example, after the reinforcing bar member is inserted into the through-holes 101, the through-holes 101 may be filled with clay, concrete, or the like. The reinforcing bar member may be press-fitted into the through-holes 101. The reinforcing bar member may pass through the through-holes 101 and may be exposed to both sides of the pile main body 100. A length at which the reinforcing bar member is exposed may be the same at both sides of the pile main body 100.

Referring to FIGS. 9A, 9B, 9C and 9D, the pull-out resistor 300 may be provided as a plurality of reinforcing bar members. At least some of the plurality of pull-out resistors 300 may be installed in the same direction. At least some of the plurality of pull-out resistors 300 may be installed perpendicular to each other. At least some of the plurality of pull-out resistors 300 may be installed at the same height. At least some of the plurality of pull-out resistors 300 may be installed at different heights. At least some of the plurality of pull-out resistors 300 may be installed adjacent to each other. In all cases, two through-holes 101 may be formed for a single pull-out resistor 300.

The plurality of pull-out resistors 300 may be composed of two to six pull-out resistors 300. When the number of pull-out resistors 300 is seven or more, due to an increase in the number of through-holes 101, fracture (brittle fracture) of the pile main body 100 may occur in the vicinity of the holes.

Figure 9A:
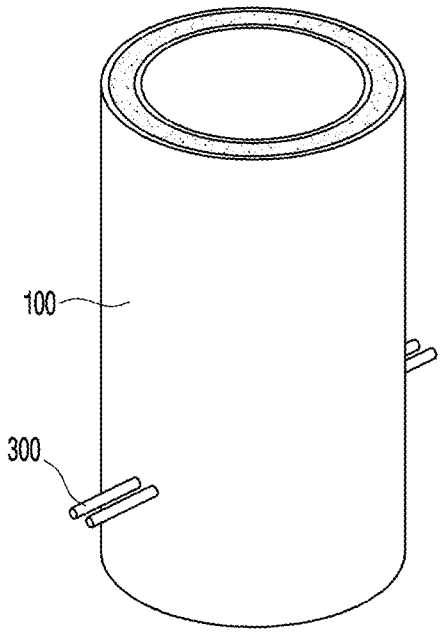
Figure 9B:
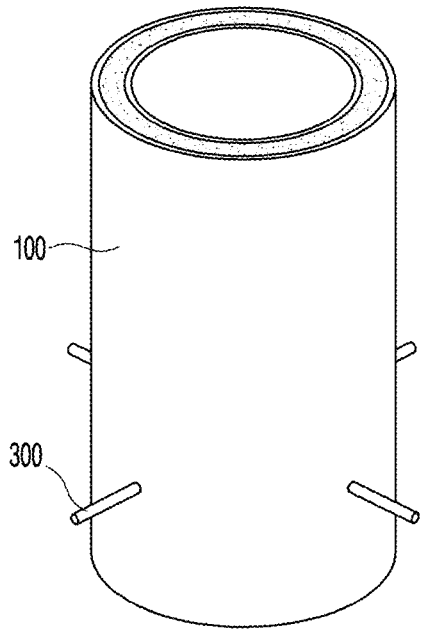
Figure 9C:
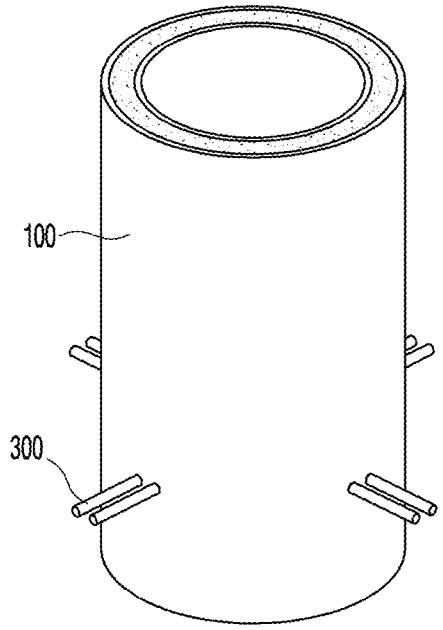
Figure 9D:
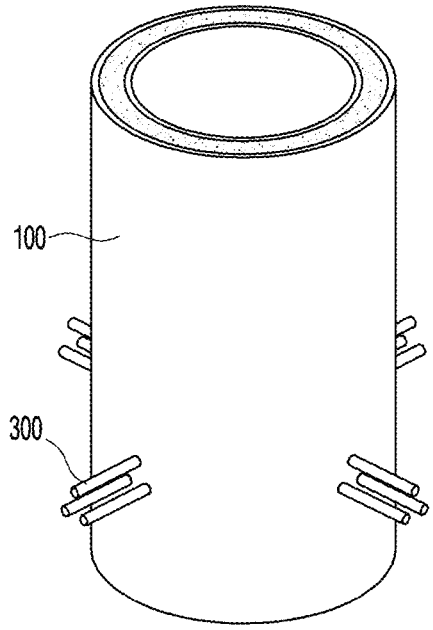

For example, referring to FIG. 9A, two pull-out resistors 300 are installed parallel to each other at the same height. Referring to FIG. 9B, two pull-out resistors 300 are installed perpendicular to each other. Also, here, the two pull-out resistors 300 are installed at different heights. Referring to FIG. 9C, among four pull-out resistors 300, two pull-out resistors 300 are installed parallel to each other at the same height, and the other two pull-out resistors 300 are installed perpendicular to the previous two pull-out resistors 300 at a different height. Referring to FIG. 9D, among six pull-out resistors 300, three pull-out resistors 300 are installed parallel to one another, and the other three pull-out resistors 300 are installed perpendicular to the previous three pull-out resistors 300. At least some of the pull-out resistors 300 installed parallel to one another are installed at different heights.

Figure 10A:
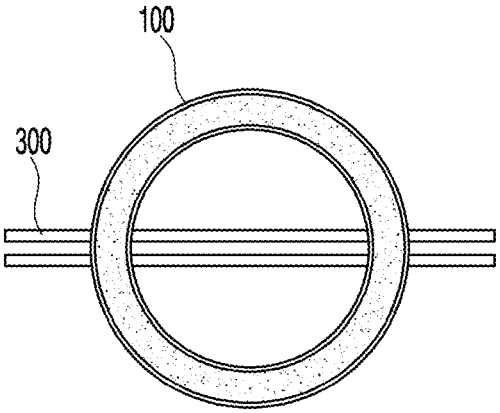
FIGS. 10A, 10B, 10C and 10D respectively show cross-sectional views of FIGS. 9A, 9B, 9C and 9D.
Figure 10B:
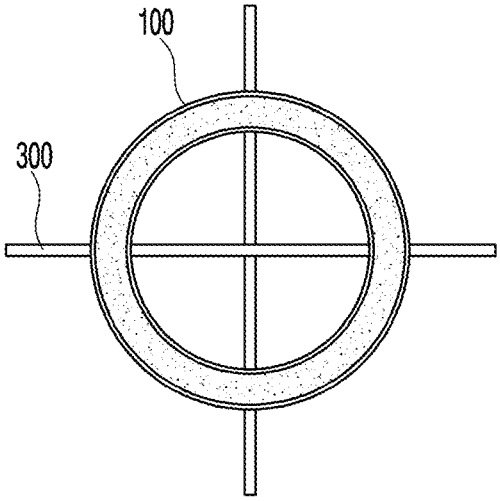
Figure 10C:
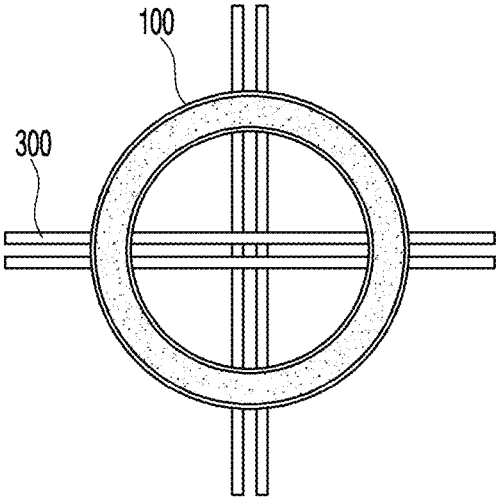
Figure 10D:
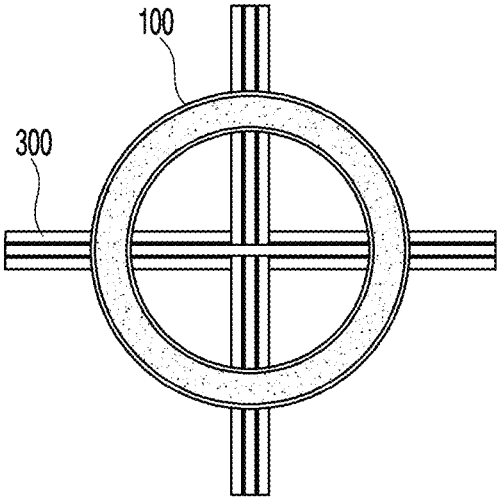

Referring to FIG. 10A, two pull-out resistors 300 are installed parallel to each other at the same height. Referring to FIG. 10B, two pull-out resistors 300 are installed perpendicular to each other. Also, here, the two pull-out resistors 300 are installed at different heights. Referring to FIG. 10C, among four pull-out resistors 300, two pull-out resistors 300 are installed parallel to each other at the same height, and the other two pull-out resistors 300 are installed perpendicular to the previous two pull-out resistors 300 at a different height. However, the present invention is not limited thereto, and all four pull-out resistors 300 may be formed at different heights. Referring to FIG. 10D, among six pull-out resistors 300, three pull-out resistors 300 are installed parallel to one another, and the other three pull-out resistors 300 are installed perpendicular to the previous three pull-out resistors 300. At least some of the pull-out resistors 300 installed parallel to one another are installed at different heights. Here, the six pull-out resistors 300 may be installed at four levels (heights). However, the present invention is not limited thereto.

Although examples in which the plurality of pull-out resistors 300 are coupled to the pile main body 100 have been described above, the present invention is not limited thereto, and the plurality of pull-out resistors 300 may be coupled in various other forms.

As described above, in the present invention, since a pull-out resistor is coupled to a pile main body, when a pile is buried in the seabed or a concrete foundation, an effect of resisting pull-out caused by an external force such as buoyancy can be obtained. Thus, the pile is suitable for subsea structure installation and has an excellent supporting force for a subsea structure.

Using a buoyancy-resistant pile for subsea structure installation according to the present invention, a subsea structure can be firmly supported.

Meanwhile, it should be noted that other advantageous effects described above and potential effects thereof not clearly mentioned herein but expected from the technical features of the present invention are also considered as the advantageous effects of the present invention.

The scope of protection of the present invention is not limited to the embodiments clearly described above. Also, changes or substitutions self-evident in the art to which the present invention pertains also belong to the protection scope of the present invention.

What is claimed is:

1. A buoyancy-resistant pile for subsea structure installation, the buoyancy-resistant pile comprising:

a pile main body including:

one end configured to be buried in a seabed or a concrete foundation;

a hollow portion;

an inner tube surrounding the hollow portion;

an outer tube surrounding the inner tube;

a concrete material filled between the inner tube and the outer tube; and at least one through-hole defined to penetrate an outer circumferential surface of the pile main body and extending to the hollow portion; and at least one pull-out resistor coupled to the outer circumferential surface of the pile main body by being inserted into the at least one through-hole, and configured to be buried in the seabed or the concrete foundation, wherein a ratio of an exposed length of the at least one pull-out resistor that is exposed outside of the pile main body to a total length of the at least one pull-out resistor is between 0.5 to 0.65, and wherein the at least one pull-out resistor includes a plurality of pull-out resistors spaced apart around the outer circumferential surface of the pile main body.

2. The buoyancy-resistant pile of claim 1, wherein:

threads are defined on an inner circumferential surface of the at least one through-hole; and the at least one pull-out resistor includes a bolt member configured to be screw-coupled to the threads of the at least one through-hole.

3. The buoyancy-resistant pile of claim 1, wherein the at least one pull-out resistor is obliquely coupled to the outer circumferential surface of the pile main body.

4. The buoyancy-resistant pile of claim 3, wherein an angle of inclination between the at least one pull-out resistor and a plane perpendicular to the outer circumferential surface of the pile main body is in a range of 0° to 50°.

5. The buoyancy-resistant pile of claim 1, wherein each of the plurality of pull-out resistors penetrates both sides of the pile main body by passing through two through-holes defined on corresponding opposite sides of the pile main body.

* * * * *